US008147204B2

(12) United States Patent
Scherer et al.

(10) Patent No.: US 8,147,204 B2
(45) Date of Patent: Apr. 3, 2012

(54) AERODYNAMIC INTERFACE COMPONENT FOR FAN BLADE

(75) Inventors: Paul T. Scherer, Lexington, KY (US); Richard A. Oleson, Lexington, KY (US)

(73) Assignee: Delta T Corporation, Lexington, KY (US)

( * ) Notice: Subject to any disclaimer, the term of this patent is extended or adjusted under 35 U.S.C. 154(b) by 866 days.

(21) Appl. No.: 12/233,783

(22) Filed: Sep. 19, 2008

(65) Prior Publication Data

US 2009/0081045 A1 Mar. 26, 2009

Related U.S. Application Data

(60) Provisional application No. 60/975,230, filed on Sep. 26, 2007.

(51) Int. Cl.
*B64C 11/04* (2006.01)
*B21K 3/04* (2006.01)

(52) U.S. Cl. ..... 416/210 R; 416/204 R; 29/889.7

(58) Field of Classification Search ..... 416/214 R, 416/210 R, 91, 204 R, 205, 223 R; 415/11, 415/119, 220; 29/889, 889.3, 889.7
See application file for complete search history.

(56) References Cited

U.S. PATENT DOCUMENTS 6,244,821 B1 6/2001 Boyd et al.
6,382,917 B1 5/2002 Zuege
6,508,629 B2 1/2003 Kerr, Jr.
6,939,108 B2 9/2005 Boyd
7,008,192 B2 3/2006 Hidalgo
7,252,478 B2 8/2007 Aynsley
7,284,960 B2 10/2007 Aynsley
2003/0219340 A1* 11/2003 Hidalgo ..... 416/206
2006/0018751 A1* 1/2006 Aynsley ..... 415/220
2008/0008596 A1 1/2008 Aynsley
2008/0014090 A1 1/2008 Aynsley et al.
2008/0213097 A1 9/2008 Oleson et al.

OTHER PUBLICATIONS

International Search Report dated Dec. 8, 2008 for Application No. PCT/US08/77629.

* cited by examiner

*Primary Examiner* — Thomas L Dickey
*Assistant Examiner* — Nikolay Yushin
(74) *Attorney, Agent, or Firm* — Frost Brown Todd LLC

(57) ABSTRACT

A fan comprises a hub, a plurality of fan blades, and a plurality of interface components. Each interface component is configured to mount at the first end of a corresponding fan blade. Each interface component is further configured to simultaneously engage an outer surface of the hub and the first end of the fan blade. For instance, the outer surface of the hub may be curved, and a hub-engaging edge of each interface component may be complementarily curved to provide a substantially continuous fit between the hub-engaging edge of each interface component and the curved outer surface of the hub. Each interface component may further comprise a resilient member configured to resiliently bear against the first end of a corresponding fan blade. In addition, each interface component may further comprise a sleeve configured to extend along a portion of the length of a corresponding fan blade.

20 Claims, 11 Drawing Sheets

AERODYNAMIC INTERFACE COMPONENT FOR FAN BLADE

PRIORITY

This application claims priority from the disclosure of U.S. Provisional Patent Application Ser. No. 60/975,230, entitled "Aerodynamic Interface Component for Fan Blade," filed Sep. 26, 2007, the disclosure of which is incorporated by reference herein in its entirety.

BACKGROUND

One merely exemplary method that may be used in the manufacture of large, High Volume/Low Speed (HVLS) fans is to attach long airfoil fan blades made by extrusion (or other techniques) to a central hub of cast metal (or other construction). An extruded airfoil, such as one of constant cross section by way of example only, may be cut off at both the inner and outer end, perpendicularly to the axis of the extrusion, or in any other suitable fashion. The outer tip of an airfoil may be finished by the addition of an aerodynamic tip or winglet. Other suitable structures that may be associated with an outer tip of an airfoil or fan blade will be apparent to those of ordinary skill in the art. Of course, the outer tip of an airfoil or fan blade may be simply closed, or may lack any similar structure at all.

In some settings, at the inboard end of a fan blade or airfoil, there may be either a gap between a straight-cut end of the airfoil and a cylindrical outer face of the hub, or else the hub itself may be cast in a polygonal shape in order to meet up with the end of the airfoil. Under some circumstances, these conditions might not be ideal when the assembly of hub and airfoils is in rotary motion; as turbulent airflow, inefficiency, and/or unwanted noise may result under some conditions. Alternatively, the inner end of the airfoil may be cut off in a curve or other configuration matching the outer configuration of the hub surface, but this may impractical in volume manufacture using some techniques.

While a variety of structures and configurations have been provided at or near a junction between a fan blade and a fan hub, it is believed that no one prior to the inventors has made or used the invention recited in the appended claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Reference will now be made in detail to various embodiments of the invention, examples of which are illustrated in the accompanying drawings. To the extent that specific dimensions are shown in the accompanying drawings, such dimensions should be regarded as merely illustrative and not limiting in any way. Accordingly, it will be appreciated that such dimensions may be varied in any suitable way.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
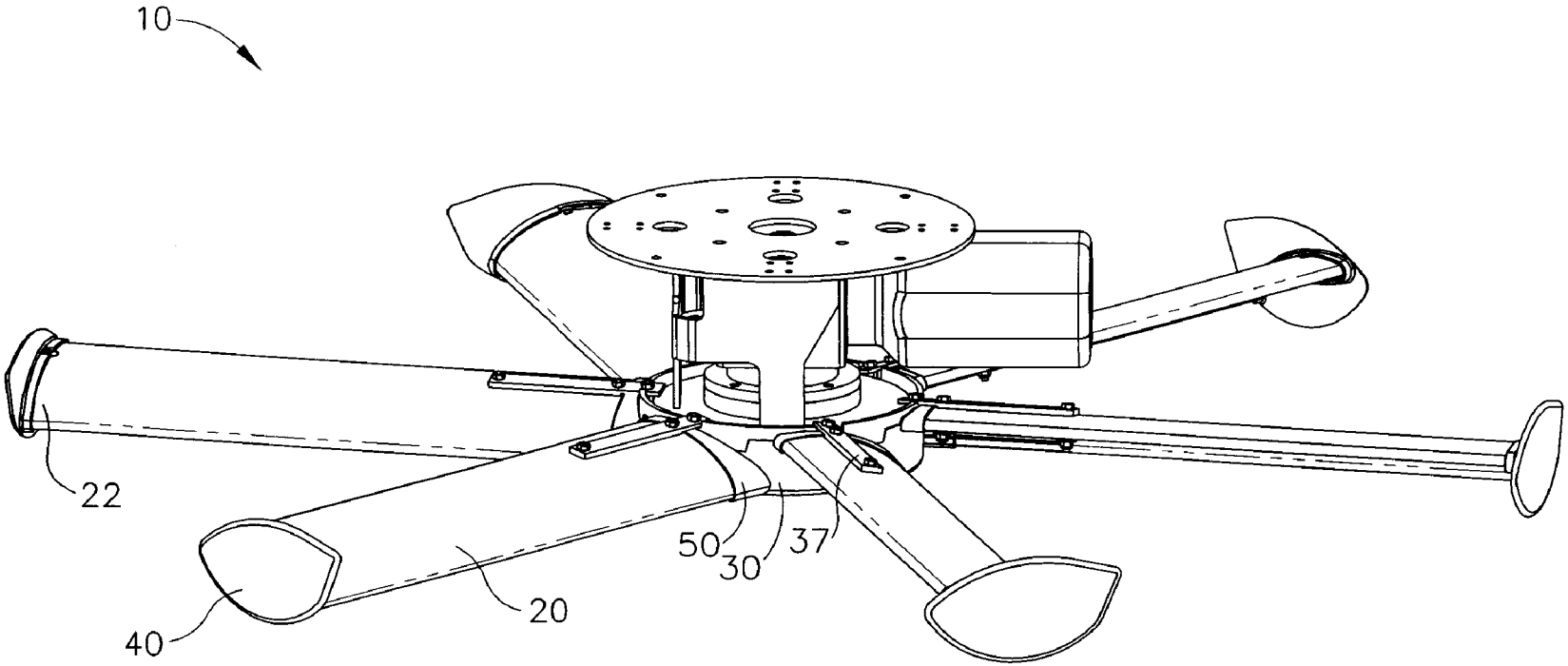
FIG. 1 depicts a perspective view of an exemplary fan system.

FIG. 1 shows a merely exemplary fan system (10). Fan system (10) of this example comprises fan blades (20) and a rotating hub (30). Winglets (40) are secured to the outer end (22) of each fan blade (20) in this example, though as with other components described herein, winglets (40) are merely optional. An interface component (50) is provided at the inner end (24) of each fan blade (20) (at the interface between each fan blade (20) and hub (30)), as will be described in greater detail below.

Figure 6:
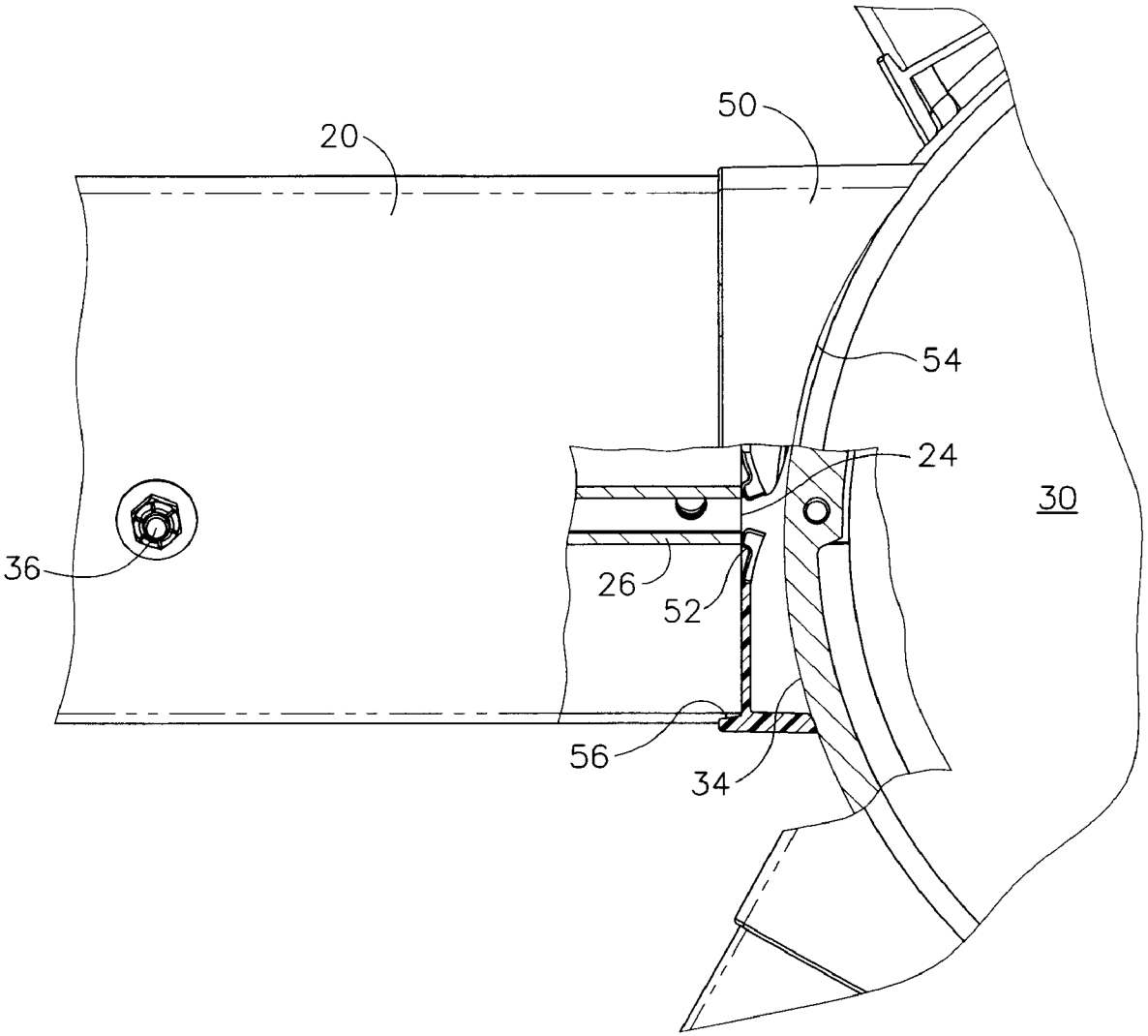
FIG. 6 depicts a partial bottom elevational view of the hub and the inner end of a fan blade of the fan system of FIG. 1, with exemplary blade-hub interface components included, with other portions of the assembly shown in cross-section.
Figure 11:
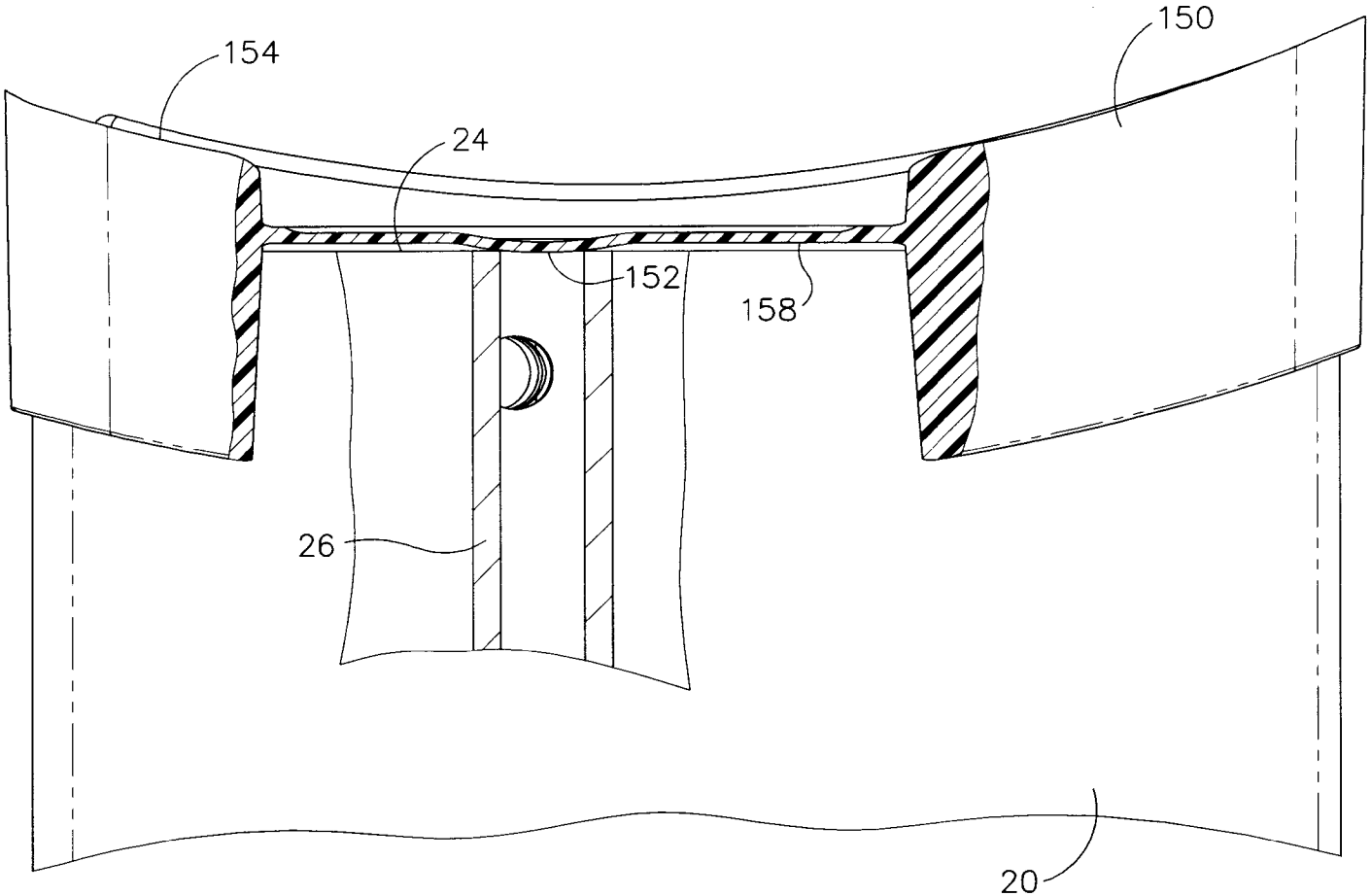
FIG. 11 depicts a top elevational view of the blade-hub interface component of FIG. 8 mounted to a fan blade, with a portion of the blade-hub interface component and a portion of the fan blade being shown in cross-section.

Fan blades (20) of the present example are substantially hollow and are formed of extruded aluminum, though any other suitable configurations, manufacturing techniques, and/or material(s) may be used. As shown in FIGS. 6 and 11, each fan blade (20) has a pair of bosses (26) extending longitudinally along the length of each fan blade (20). Of course, bosses (26) may or may not extend along the full length of each fan blade (20), as desired. Bosses (26) may extend vertically through the entire interior height of each fan blade (20). Alternatively, bosses (26) may extend vertically through a portion of the interior height of each fan blade (20). For instance, in the present example, a first set of bosses (26) extends downwardly from the top interior surface of fan blade (20), without extending through the full interior height of fan blade (20); while a second set of bosses (26) extends upwardly from the bottom interior surface of fan blade (20), without extending through the full interior height of fan blade (20). In other words, an empty vertical space is provided within the interior of fan blades (20), between the bottoms of an upper set of bosses (26) and the tops of a lower set of bosses (26), in the present example. Alternatively, bosses (26) may have any other desired configurations, features, or properties; or bosses (26) may be substituted, supplemented, or omitted as desired.

By way of example only, fan blades (20) may be configured in accordance with any of the teachings in U.S. Pat. No. 7,284,960, entitled "Fan Blades," issued Oct. 23, 2007, the disclosure of which is incorporated by reference herein. Alternatively, fan blades (20) may be configured in accordance with any of the teachings in U.S. Pub. No. 2008/0008596, entitled "Fan Blades," published Jan. 10, 2008, the disclosure of which is incorporated by reference herein. In other versions, fan blades (20) are configured in accordance with any of the teachings in U.S. Pat. No. 6,244,821, entitled "Low Speed Cooling Fan," issued Jun. 12, 2001, the disclosure of which is incorporated by reference herein. In some other versions, fan blades (20) are configured in accordance with any of the teachings in U.S. Pat. No. 6,939,108, entitled "Cooling Fan with Reinforced Blade," issued Sep. 6, 2005, the disclosure of which is incorporated by reference herein. Still other suitable configurations for fan blades (20) will be apparent to those of ordinary skill in the art in view of the teachings herein.

Winglets (40) may be configured in accordance with any of the teachings in U.S. Pat. No. 7,252,478, entitled "Fan Blade Modifications," issued Aug. 7, 2007, the disclosure of which is incorporated by reference herein. Alternatively, winglets (40) may be configured in accordance with any of the teachings in U.S. Pub. No. 2008/0014090, entitled "Cuffed Fan Blade Modifications," published Jan. 17, 2008, the disclosure of which is incorporated by reference herein. In other versions, winglets (40) are configured in accordance with any of the teachings in U.S. Pub. No. 2008/0213097, entitled "Angled Airfoil Extension for Fan Blade," published Sep. 4, 2008, the disclosure of which is incorporated by reference herein. Still other suitable configurations for winglets (40) will be apparent to those of ordinary skill in the art in view of the teachings herein. Of course, as with other components described herein, winglets (40) may simply be omitted altogether.

Figure 2:
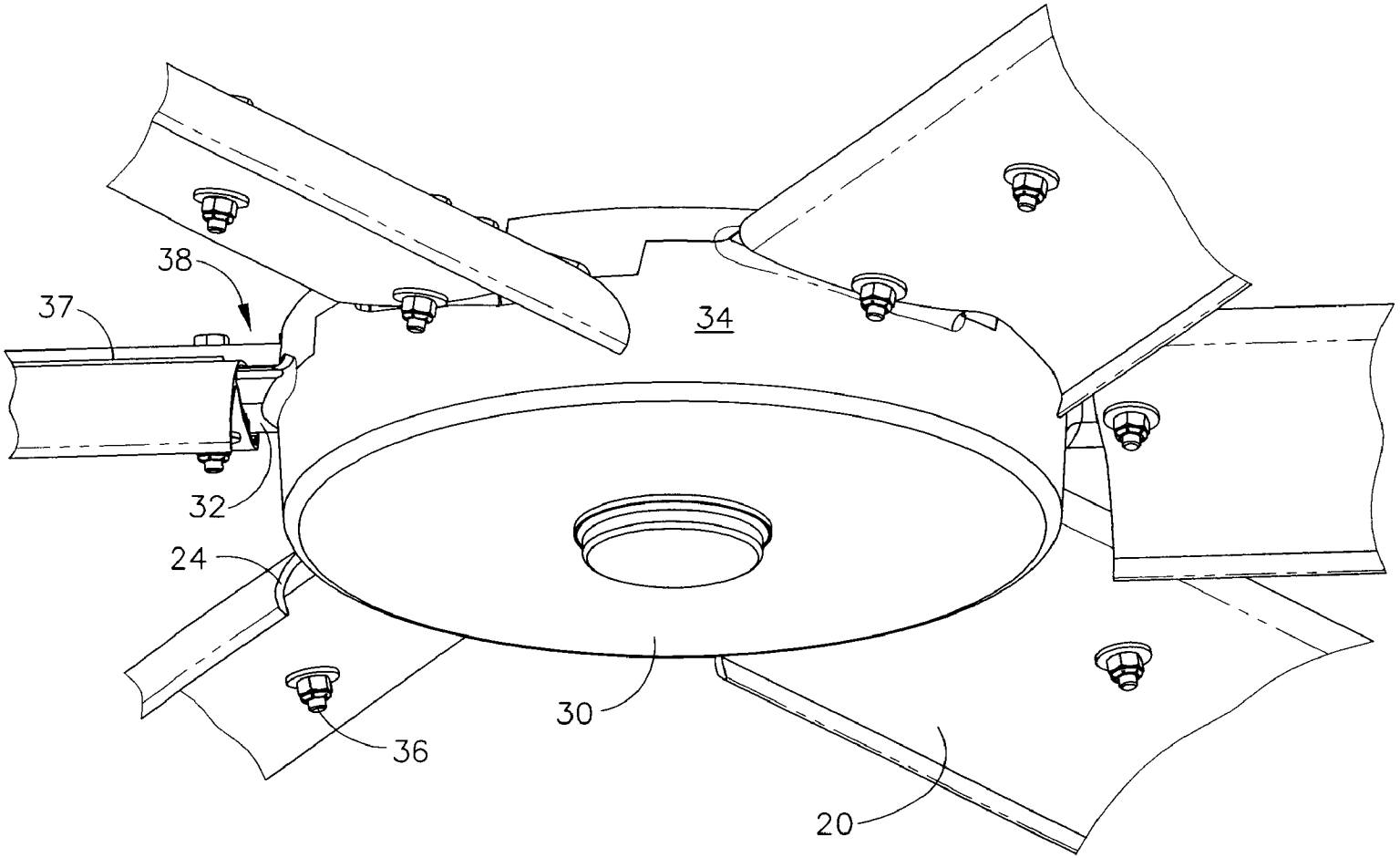
FIG. 2 depicts a partial perspective view of the bottom of the hub and inner ends of the fan blades of the fan system of FIG. 1, with exemplary blade-hub interface components removed.
Figure 3:
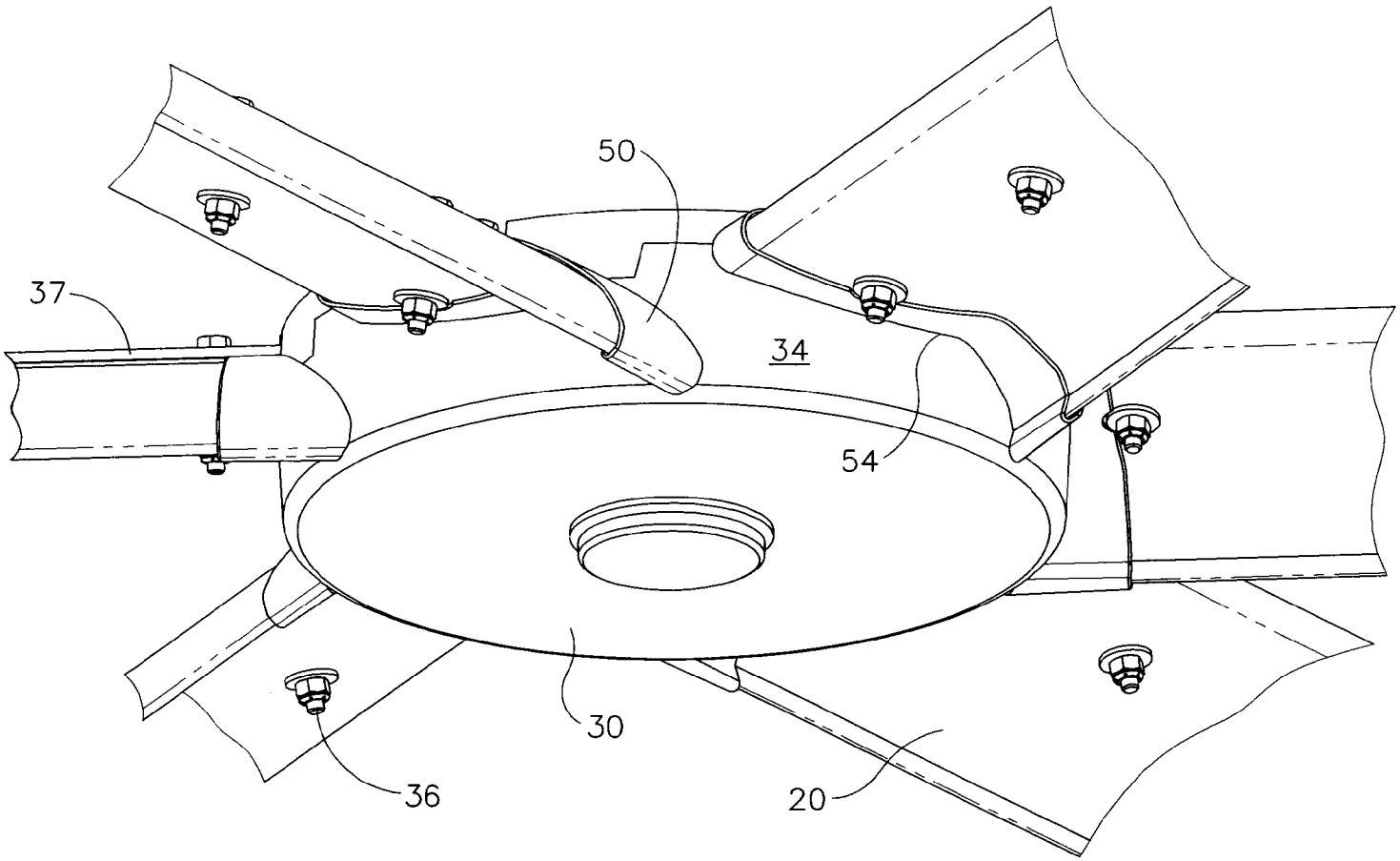
FIG. 3 depicts a partial perspective view of the bottom of the hub and inner ends of the fan blades of the fan system of FIG. 1, with exemplary blade-hub interface components included.
Figure 4:
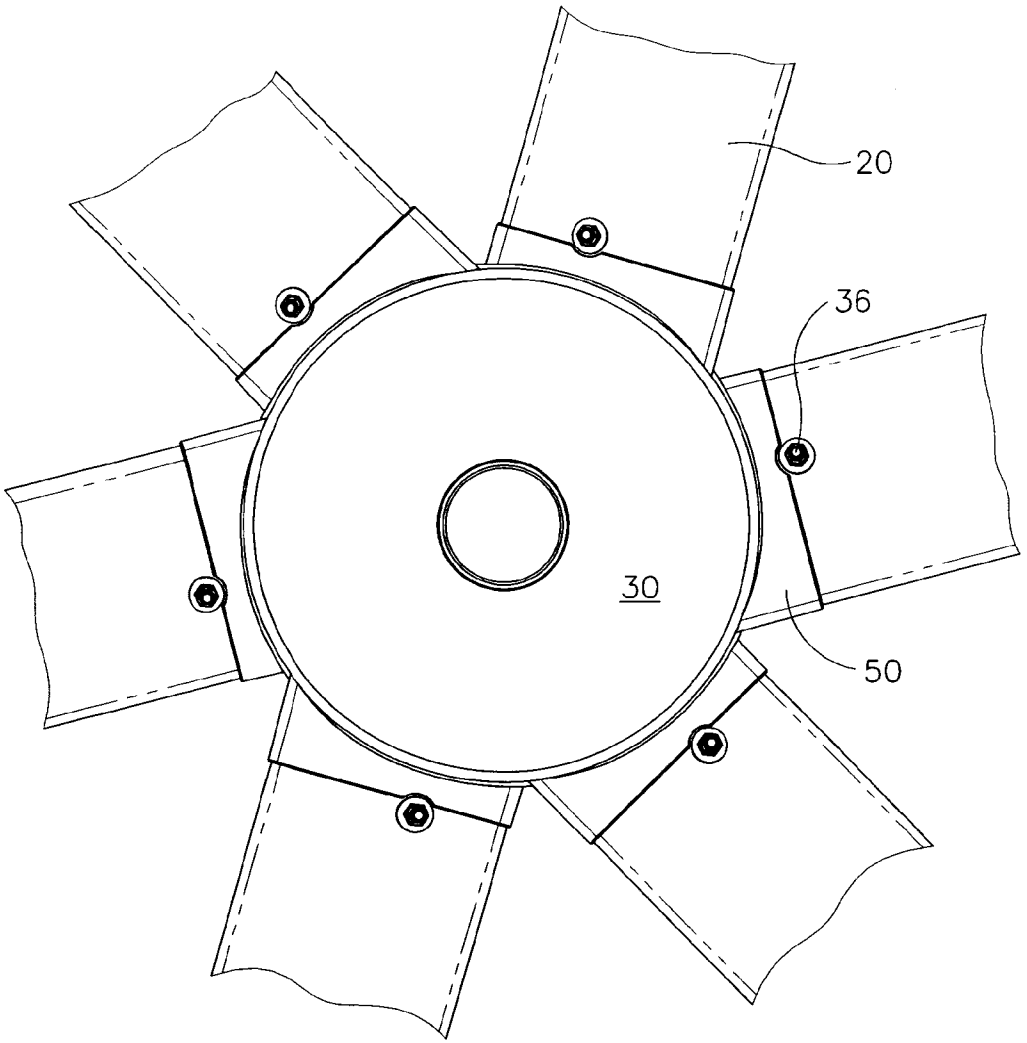
FIG. 4 depicts a partial bottom elevational view of the hub and inner ends of the fan blades of the fan system of FIG. 1, with exemplary blade-hub interface components included.
Figure 5:
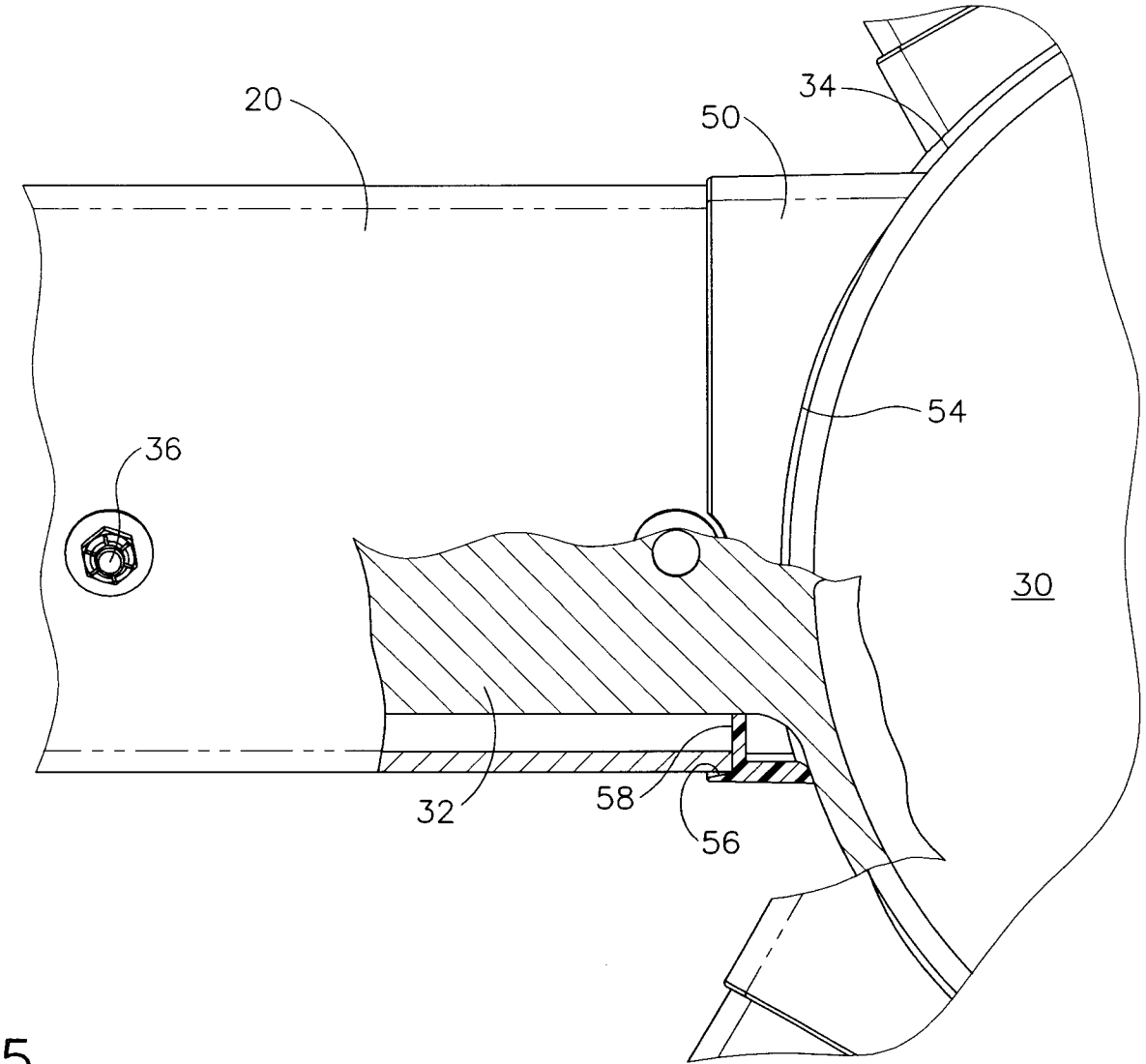
FIG. 5 depicts a partial bottom elevational view of the hub and the inner end of a fan blade of the fan system of FIG. 1, with exemplary blade-hub interface components included, with portions of the assembly shown in cross-section.

As shown in FIGS. 2 and 5, hub (30) comprises a plurality of mounting members (32) extending radially outwardly relative to outer face (34) of hub (30). With fan blades (20) being hollow in the present example, mounting members (32) are inserted into the interior of fan blades (20). In other versions, mounting members (32) have a hollow interior, such that fan blades (20) may be inserted into the hollow interior of mounting members (32). In still other versions, a portion of mounting member (32) is provided within an interior of fan blade (20); while a portion of fan blade (20) is provided within an interior of mounting member (32). Alternatively, any other suitable structures and relationships between fan blade (20) and mounting members (32) may be used.

In the present example, fasteners (36) are inserted through each fan blade (20) and a corresponding mounting member (32) to secure fan blades (20) to hub (30). In the present example, fasteners (36) comprise bolts, though any other suitable types of fasteners (36) may be used, including but not limited to pins, rivets, etc. Furthermore, any other suitable structures or techniques may be used to secure fan blades (20) to hub (30), including but not limited to welding, integral molding, snap-fitting, etc. Metal straps (37) are also included in the present example to further secure the connection between fan blades (20) and hub (30), though these are also merely optional.

As illustrated in FIG. 2, inner end (24) of each fan blade (20) is substantially flat, while outer face (34) of hub (30) is substantially curved. Thus, a gap (38) is present at the interface of each fan blade (20) and hub (30). In some settings, gaps (38) may tend to reduce the efficiency of fan system (10), produce turbulence, and/or produce unwanted noise. In other settings, gaps (38) may not produce such effects, or such effects may be otherwise negligible.

As shown in FIGS. 3-6, interface component (50) may be used to cover and/or close gap (38) that may be otherwise present between inner end (24) of fan blade (20) and outer face (34) of hub (30). In some situations, interface component (50) may improve the aerodynamics of fan system (10), improve efficiency, reduce turbulence, and/or reduce unwanted noise. In other situations, interface component (50) may provide only some of those results, none of those results, or other results.

Figure 7:
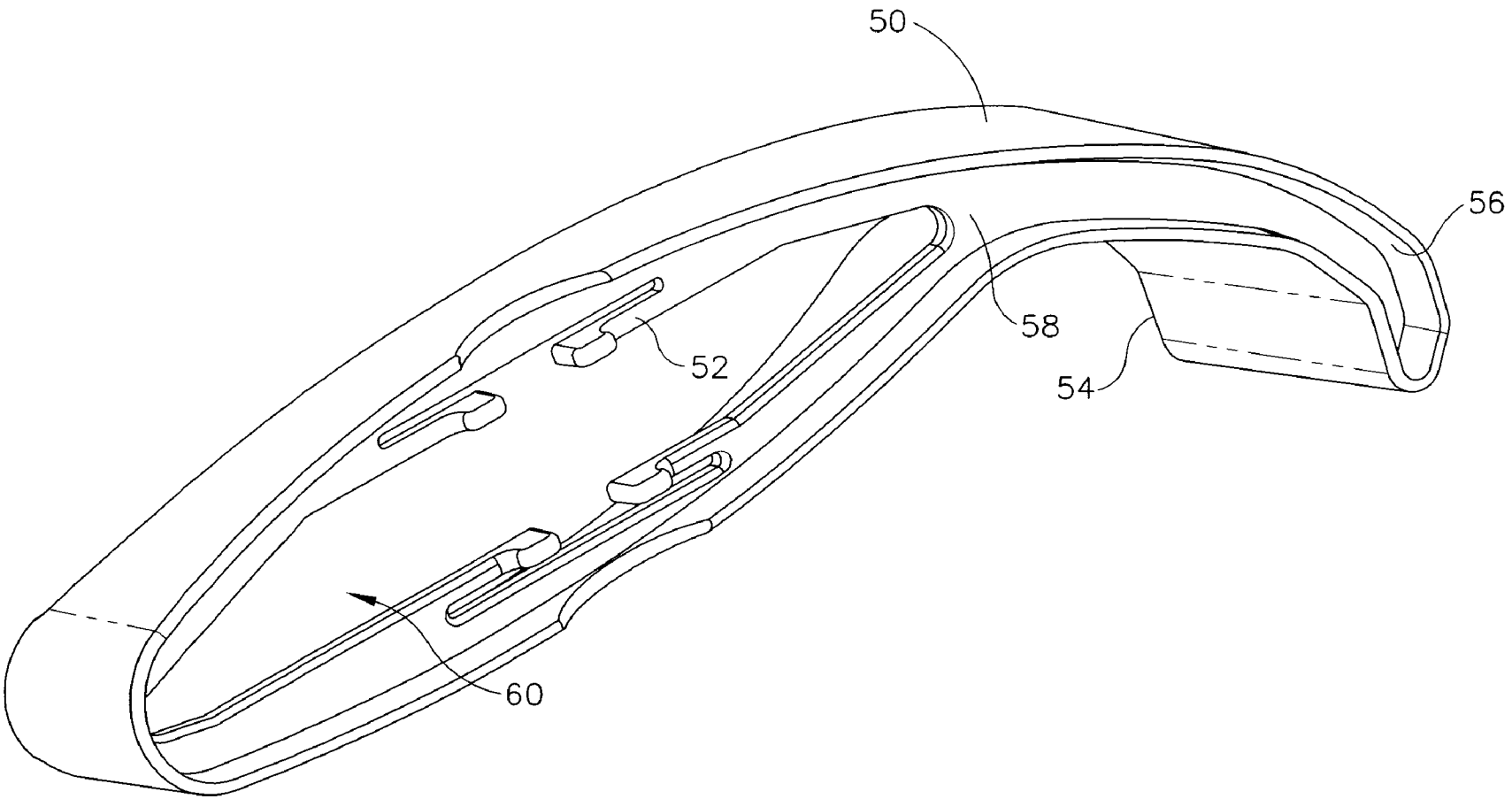
FIG. 7 depicts a perspective view of the blade-hub interface component of the fan system of FIG. 1, showing a blade-facing side of the blade-hub interface component.

Even with interface component (50), however, small gaps may remain in some situations, due to normal variations in the manufacturing processes of the various component parts in fan system (10), or for other reasons. It may therefore be desirable in some situations for interface component (50) to include some components or features to compensate for these variations, such as to eliminate gaps (38) to the greatest possible extent. For instance, in the present example, interface component (50) comprises a plurality of cantilever springs (52), as shown in FIGS. 6-7. Cantilever springs (52) are integrally molded as part of interface component (50) in the present example, though interface component (50) may be otherwise provided with cantilever springs (52). Furthermore, interface component (50) may have other features (e.g., other types of resilient members, etc.) in addition to or in lieu of cantilever springs (52).

As shown in FIG. 6, cantilever springs (52) are configured to bear against bosses (26) at inner end (24) of fan blades (20). Cantilever springs (52) may thus force or urge interface component (50) against outer face (34) of hub (30) (e.g., in a radially inward direction). Interface component (50) has a hub-facing edge (54) that is contoured to approximately match the curvature of outer face (34) of hub (30). Hub-facing edge (54) may thus provide a substantially flush fit between interface component (50) and outer face (34) of hub (30). In some other versions, hub-facing edge (54) and/or outer face (34) of hub (30) may be substantially flat, angled, or have any other suitable configuration. Hub-facing edge (54) may also be substantially rigid, flexible, resilient, or have any other suitable properties.

In the present example, the constant pressure applied by cantilever springs (52) or other resilient members may yield or at least encourage constant and/or substantially continuous contact between hub (30) and interface component (50), thereby eliminating gaps (38) to an appreciable degree. Other structures or techniques that may be used to encourage substantially full or substantially continuous contact between hub (30) and interface component (50), in addition to or in lieu of cantilever springs (52) or other resilient members, will be apparent to those of ordinary skill in the art in view of the teachings herein.

While cantilever springs (52) have been described as being included to compensate for variations in the manufacturing processes of the various component parts in fan system (10), it should be understood that cantilever springs (52) need not necessarily be provided to serve such a purpose. In other words, cantilever springs (52) may serve a variety of other purposes, in addition to or in lieu of compensating for variations in the manufacturing processes of the various component parts in fan system (10). Similarly, a variety of other components, structures, or features may be provided in addition to or in lieu of cantilever springs (52), to compensate for variations in the manufacturing processes of the various component parts in fan system (10) and/or for any other purpose (s). Such other purposes and other suitable components, structures, or features will be apparent to those of ordinary skill in the art in view of the teachings herein.

Maintaining substantially constant and substantially continuous contact between interface component (50) and hub (30), in circumstances of varying dimensions of other components in the assembly or under other circumstances, may warrant some additional structural features to accommodate these variations so that a gap does not occasionally occur where interface component (50) meets up with inner end (24) of fan blade (20). In some versions, this may be accommodated by configuring at least a portion of interface component (50) in the form of a sleeve (56), into which inner end (24) of fan blade (20) may be inserted. This arrangement may permit the position of inner end (24) of fan blade (20) to vary slightly, while still remaining fully contained within sleeve (56), thereby increasing the chances that aerodynamic properties are not affected by these variations. The outer perimeter of sleeve (56) thus created may be formed to mimic the shape of fan blade (20) itself, so that the designed benefits of fan blade (20) may be substantially maintained all the way to outer face (34) of hub (30). For instance, as shown in FIG. 7, the outer perimeter of sleeve (56) substantially mimics the shape of a fan blade shown and described in U.S. Pub. No. 2008/0008596, entitled "Fan Blades," published Jan. 10, 2008, the disclosure of which is incorporated by reference herein. Alternatively, sleeve (56) may have any other desired configuration. Furthermore, as with other components described herein, sleeve (56) is merely optional, and sleeve (56) may be substituted, supplemented, modified, or even omitted, as desired.

A combination of cantilever springs (52) (or other resilient members, etc.) substantially eliminating any clearance between mating hub (30) and fan blade (20) in the direction of the axis of fan blade (20), and sleeve (56) preventing relative displacement of fan blade (20) perpendicular to that axis, may provide positive retention and location of interface component (50) without a need for any additional fasteners to retain the position of interface component (50) in the assembly. Of course, one or more fasteners or other structures, components, or features may be used to retain the position of interface component (50) if desired.

In some versions, interface component (50) is molded of a lightweight thermoplastic polymer material that has inherent vibration-damping properties to minimize noise, as well as resilience to maintain reliable performance in molded cantilever springs (52) or other resilient members. An example of such a polymer material is Polypropylene. Of course, any other suitable material (or combination of materials) may be used to form an interface component (50), and such material (s) may have any other suitable properties. Similarly, any suitable process other than or in addition to molding may be used to form interface component (50).

As shown in FIG. 7, a web (58) of interface component (50) defines an opening (60) through which mounting member (32) of hub (30) may be inserted. Opening (60) may have a shape that complements the shape of mounting member (32) (e.g., to provide a snug fit or other type of fit, etc.), or may have any other desired shape. As is also shown, exemplary cantilever springs (52) extend integrally from web (58). However, any suitable alternative to web (58) may be used, and cantilever springs (52) (or any substitute or supplement for cantilever springs (52)) may be positioned at any other suitable location or be otherwise provided. As is also shown, web (58) of the present example is recessed relative to each outer edge of interface component (50), in part due to the presence of sleeve (56). Again, though, this configuration is merely exemplary. Other suitable configurations for interface component (50), including alternative features, components, arrangements of components, etc., will be apparent to those of ordinary skill in the art in view of the teachings herein.

A merely exemplary alternative interface component (150) is shown in FIGS. 8-11. Interface component (150) comprises an integral spring (152), a hub-facing edge (154), a sleeve (156), a web (158), and an opening (160). Interface component (150) may be positioned at the interface between fan blade (20) and hub (30). In this example, interface component (150) has many similarities with interface component (50) described above. For instance, interface component (50) may be used to cover and/or close a gap (38) that may be otherwise present between inner end (24) of fan blade (20) and outer face of hub (30). In some situations, interface component (150) may improve the aerodynamics of fan system (10), improve efficiency, reduce turbulence, and/or reduce unwanted noise. In other situations, interface component (150) may provide only some of those results, none of those results, or other results.

Figure 8:
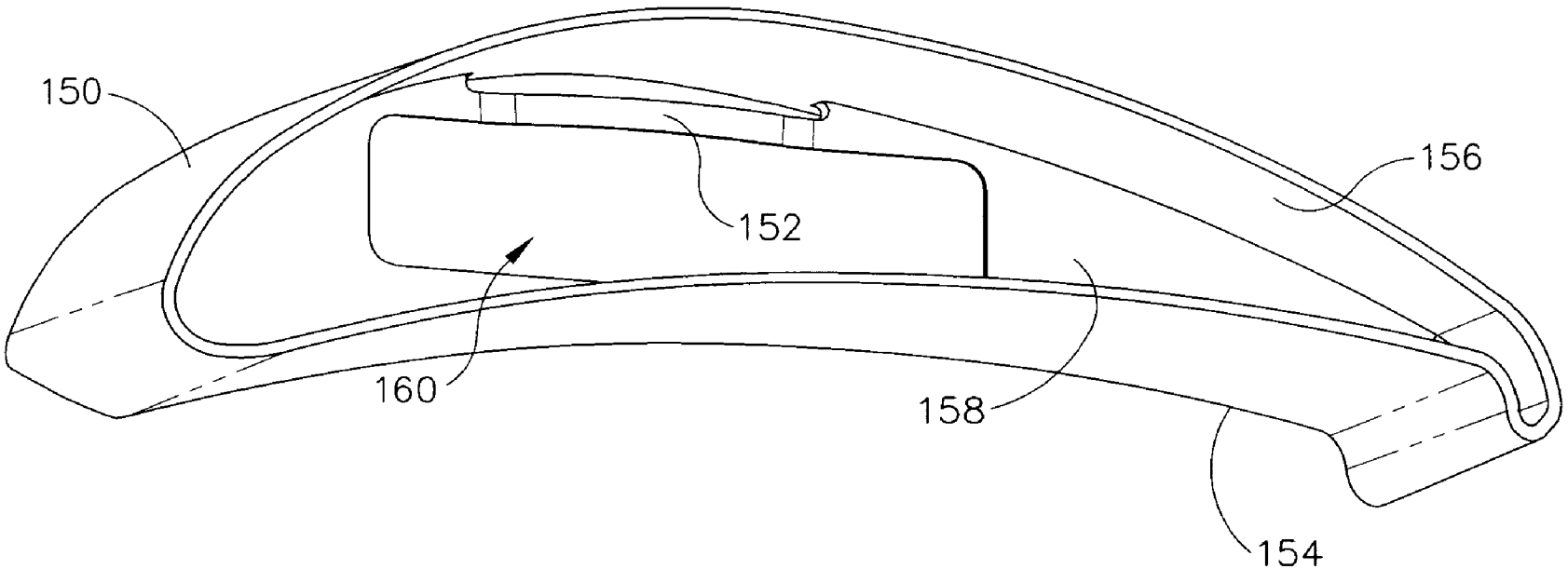
FIG. 8 depicts a perspective view of a merely exemplary alternative blade-hub interface component, showing a blade-facing side of the blade-hub interface component.
Figure 9:
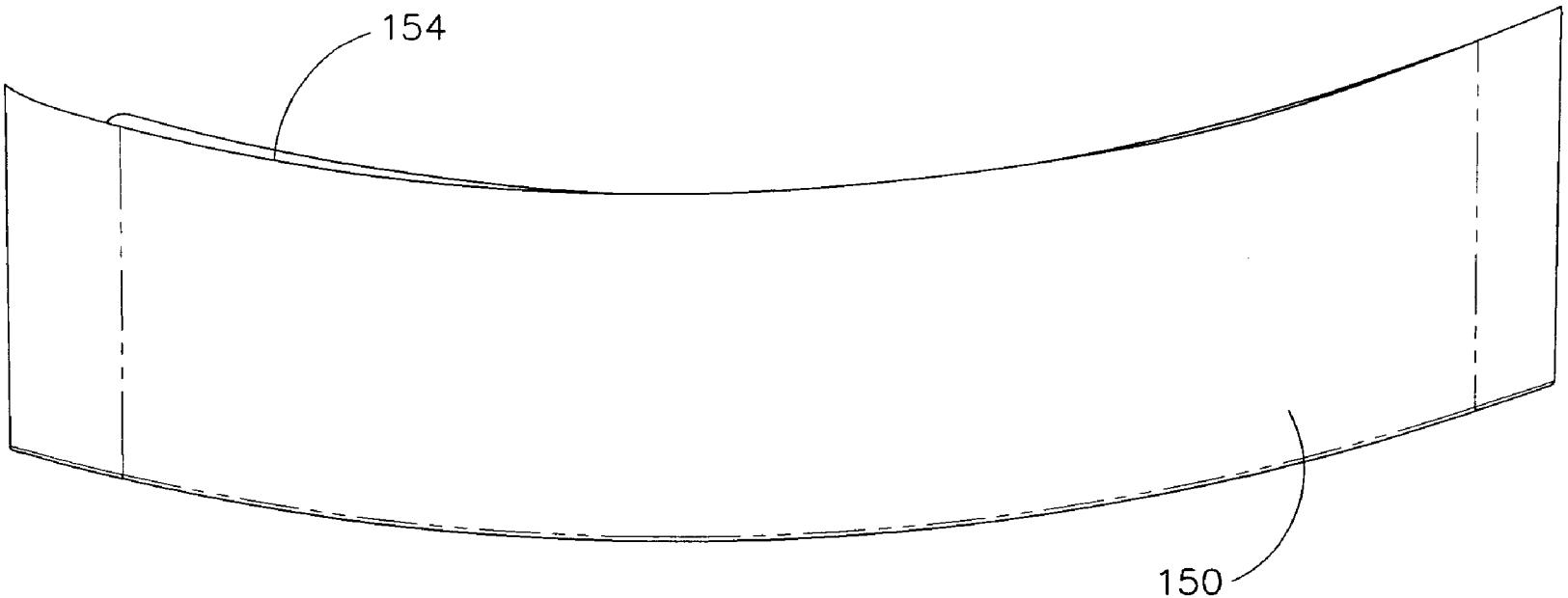
FIG. 9 depicts a top elevational view of the blade-hub interface component of FIG. 8.
Figure 10:
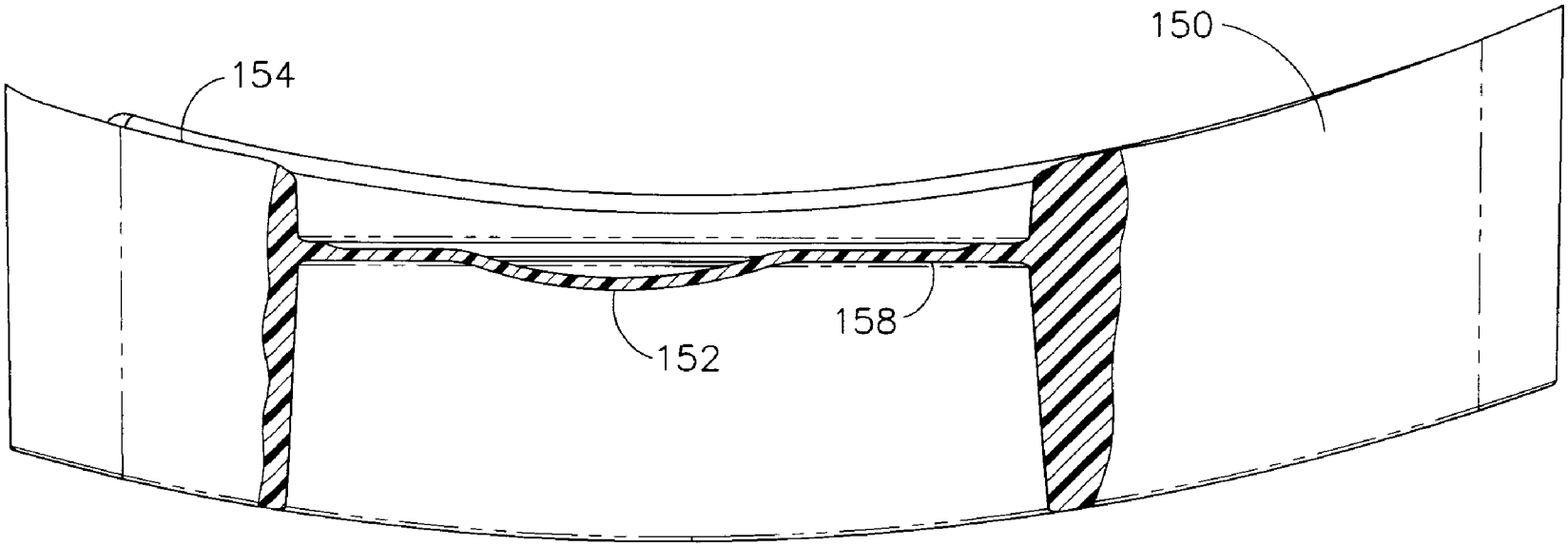
FIG. 10 depicts a top elevational view of the blade-hub interface component of FIG. 8, with a portion of the blade-hub interface component being shown in cross-section.

While interface component (50) has a pair of cantilever springs (52), interface component (150) has a single integral spring (152), as shown in FIGS. 8 and 10-11. Integral spring (152) extends laterally from web (158), and has a convex configuration for engaging inner end (24) of fan blade (20). In particular, and as shown in FIG. 11, integral spring (152) is configured to bear against bosses (26) at inner end (24) of fan blades (20). Integral spring (152) may thus force or urge interface component (150) against outer face (34) of hub (30) (e.g., in a radially inward direction). Interface component (150) has a hub-facing edge (154) that is contoured to approximately match the curvature of outer face (34) of hub (30). Hub-facing edge (154) may thus provide a substantially flush fit between interface component (50) and outer face (34) of hub (30). In some other versions, hub-facing edge (154) and/or outer face (34) of hub (30) may be substantially flat, angled, or have any other suitable configuration. Hub-facing edge (154) may also be substantially rigid, flexible, resilient, or have any other suitable properties.

While integral spring (152) is described herein as being an integrally formed feature of interface component (150), it should be understood that integral spring (152) may be added to interface component (150) after interface component (150) is formed. By way of example only, interface component (150) may be a unitary piece of plastic, while spring (152) may be a metal leaf spring or other component that is integrally secured to interface component (150). Thus, the inventors contemplate a variety of alternative configurations of, materials for, and relationships between integral spring (152) and the remainder of interface component (150). Interface component (50) and cantilever springs (52) may also be subject to such variations in materials, relationships, configurations, etc.

In the present example, the constant pressure applied by integral spring (152) or other resilient members may yield or at least encourage constant and/or substantially continuous contact between hub (30) and interface component (150), thereby eliminating gaps (38) to an appreciable degree. Other structures or techniques that may be used to encourage substantially full or substantially continuous contact between hub (30) and interface component (150), in addition to or in lieu of integral spring (152) or other resilient members, will be apparent to those of ordinary skill in the art in view of the teachings herein.

While integral spring (152) has been described as being included to compensate for variations in the manufacturing processes of the various component parts in fan system (10), it should be understood that integral spring (152) need not necessarily be provided to serve such a purpose. In other words, integral spring (152) may serve a variety of other purposes, in addition to or in lieu of compensating for variations in the manufacturing processes of the various component parts in fan system (10). Similarly, a variety of other components, structures, or features may be provided in addition to in lieu of integral spring (152) (e.g., cantilever springs (52), etc.), to compensate for variations in the manufacturing processes of the various component parts in fan system (10) and/or for any other purpose(s). Such other purposes and other suitable components, structures, or features will be apparent to those of ordinary skill in the art in view of the teachings herein.

Maintaining substantially constant and substantially continuous contact between interface component (150) and hub (30), in circumstances of varying dimensions of other components in the assembly or under other circumstances, may warrant some additional structural features to accommodate these variations so that a gap does not occasionally occur where interface component (150) meets up with inner end (24) of fan blade (20). In some versions, this may be accommodated by configuring at least a portion of interface component (150) in the form of a sleeve (156), into which inner end (24) of fan blade (20) may be inserted. This arrangement may permit the position of inner end (24) of fan blade (20) to vary slightly, while still remaining fully contained within sleeve (156), thereby increasing the chances that aerodynamic properties are not affected by these variations. The outer perimeter of sleeve (156) thus created may be formed to mimic the shape of fan blade (20) itself, so that the designed benefits of fan blade (20) may be substantially maintained all the way to outer face (34) of hub (30). For instance, as shown in FIG. 7, the outer perimeter of sleeve (56) substantially mimics the shape of a fan blade shown and described in U.S. Pat. No. 7,284,960, entitled "Fan Blades," issued Oct. 23, 2007, the disclosure of which is incorporated by reference herein. Alternatively, sleeve (56) may have any other desired configuration. Furthermore, as with other components described herein, sleeve (156) is merely optional, and sleeve (156) may be substituted, supplemented, modified, or even omitted, as desired.

A combination of integral spring (152) (or other resilient members, etc.) substantially eliminating any clearance between mating hub (30) and fan blade (20) in the direction of the axis of fan blade (20), and sleeve (156) preventing relative displacement of fan blade (20) perpendicular to that axis, may provide positive retention and location of interface component (150) without a need for any additional fasteners to retain the position of interface component (150) in the assembly. Of course, one or more fasteners or other structures, components, or features may be used to retain the position of interface component (150) if desired.

In some versions, interface component (150) is molded of a lightweight thermoplastic polymer material that has inherent vibration-damping properties to minimize noise, as well as resilience to maintain reliable performance in molded integral spring (152) or other resilient members. An example of such a polymer material is Polypropylene. Of course, any other suitable material (or combination of materials) may be used to form an interface component (150), and such material (s) may have any other suitable properties. Similarly, any suitable process other than or in addition to molding may be used to form interface component (150).

As shown in FIG. 8, a web (158) of interface component (150) defines an opening (160) through which mounting member (32) of hub (30) may be inserted. Opening (160) may have a shape that complements the shape of mounting member (32) (e.g., to provide a snug fit or other type of fit, etc.), or may have any other desired shape. As is also shown, exemplary integral spring (152) is formed integrally with web (158). However, any suitable alternative to web (158) may be used, and integral spring (152) (or any substitute or supplement for integral spring (152)) may be positioned at any other suitable location or be otherwise provided. As is also shown, web (158) of the present example is recessed relative to each outer edge of interface component (150), in part due to the presence of sleeve (156). Again, though, this configuration is merely exemplary. Other suitable configurations for interface component (150), including alternative features, components, arrangements of components, etc., will be apparent to those of ordinary skill in the art in view of the teachings herein.

In some embodiments, the maximum rotational speed of fan (10) is between approximately 125 RPM, inclusive, and approximately 250 RPM, inclusive. For instance, a maximum rotational speed of approximately 180 RPM may be used. In some other versions, a maximum rotational speed may be between approximately 50 RPM, inclusive, and approximately 100 RPM, inclusive. For instance, a maximum rotational speed of approximately 82 RPM may be used. Of course, any other suitable rotational speed may be used.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A fan, the fan comprising:

(a) a hub, wherein the hub is configured to rotate, wherein the hub has a fan blade engaging region;

(b) a plurality of fan blades with first and second ends, wherein the first end of each fan blade has an edge, wherein the first end of each fan blade is configured to mount to the hub at the fan blade engaging region of the hub;

(c) an plurality of interface components, wherein each interface component is configured to mount at the first end of a corresponding fan blade of the plurality of fan blades, wherein each interface component is configured to simultaneously engage an outer surface of the hub and the first end of the fan blade, wherein each interface component is configured to substantially close a gap between the edge of the first end of the corresponding fan blade and the outer surface of the hub.

2. The fan of claim 1, wherein the fan blade engaging region of the hub comprises a vertical outer face of the hub.

3. The fan of claim 2, wherein each interface component is configured to simultaneously engage the vertical outer face of the hub and the first end of the fan blade.

4. The fan of claim 2, wherein the vertical outer face of the hub is curved.

5. The fan of claim 4, wherein each interface component has a hub-engaging edge, wherein the hub-engaging edge of each interface component is curved to complement the curved vertical outer face of the hub to provide a substantially continuous fit between the hub-engaging edge of each interface component and the curved vertical outer face of the hub.

6. The fan of claim 2, wherein the fan blade engaging region further comprises a plurality of fan blade engaging members, wherein the fan blade engaging members of the hub extend radially outward.

7. The fan of claim 6, wherein the fan blades are substantially hollow.

8. The fan of claim 7, wherein each fan blade engaging member of the hub is configured to be inserted within a corresponding fan blade of the plurality of fan blades.

9. The fan of claim 8, wherein each interface component defines an opening sized and configured to receive a corresponding fan blade engaging member of the hub.

10. The fan of claim 1, wherein each interface component comprises at least one resilient member, wherein the at least one resilient member of each interface component is configured to resiliently bear against the first end of a corresponding fan blade.

11. The fan of claim 10, wherein the at least one resilient member of each interface component comprises a plurality of cantilever springs.

12. The fan of claim 10, wherein the at least one resilient member of each interface component comprises a curved integral spring.

13. The fan of claim 10, wherein each interface component further comprises a web, wherein the at least one resilient member of each interface component is integrally formed with the web of the corresponding interface component.

14. The fan of claim 1, wherein each interface component further comprises a sleeve, wherein the sleeve of each interface component is configured to extend along a portion of the length of a corresponding fan blade of the plurality of fan blades.

15. The fan of claim 14, wherein each interface component further comprises a web, wherein each sleeve terminates in a corresponding web.

16. The fan of claim 1, wherein each fan blade has an airfoil shape, wherein each interface component has an airfoil shape.

17. The fan of claim 16, wherein the airfoil shape of each interface component complements the airfoil shape of each corresponding fan blade.

18. A fan blade interface component, comprising:

(a) a sleeve portion configured to receive a fan blade end, wherein the fan blade end has an outer surface and an edge, wherein the sleeve portion is configured to extend along a portion of the length of the outer surface of the fan blade end;

(b) a hub engaging portion, wherein the hub engaging portion is configured to substantially continuously engage a fan hub outer face and to substantially close a gap defined between the edge of the first end of the fan blade and the outer face of the hub; and (c) at least one resilient member, wherein the at least one resilient member is configured to resiliently bear against the edge of the fan blade end to resiliently bias the hub engaging portion against the outer face of the hub.

19. The fan blade interface component of claim 18, wherein the at least one resilient member comprises a pair of cantilever springs.

20. A method of fitting an interface component to a fan, wherein the fan comprises a hub and a plurality of fan blades, wherein the hub is configured to rotate, wherein the hub comprises a plurality of radially extending fan blade mounting members and an outer surface adjacent to the radially extending fan blade mounting members, wherein each of the fan blades has a first end and a second end, wherein the first end of each fan blade has an outer edge, wherein the first end of each fan blade is configured to engage a corresponding fan blade mounting member of the plurality of fan blade mounting members while defining a gap between the outer edge of the fan blade and the hub, wherein the interface component comprises a sleeve configured to receive the first end of a corresponding fan blade of the plurality of fan blades, wherein each interface component defines an opening configured to receive a corresponding fan blade mounting member of the plurality of fan blade mounting members, the method comprising:

(a) positioning each interface component of the plurality of interface components about a corresponding fan blade mounting member of the plurality of fan blade mounting members, wherein the act of positioning comprises passing each fan blade mounting member through the opening defined by each corresponding interface component;

(b) positioning each interface component of the plurality of interface components to engage the outer surface of the hub;

(c) inserting the first end of each fan blade into the sleeve of a corresponding interface component of the plurality of interface components, such that the outer edge of the fan blade is enclosed within the sleeve and such that the sleeve substantially closes a gap defined between the outer edge of the first end of the fan blade and the outer surface of the hub; and (d) securing each fan blade relative to a corresponding fan blade mounting member of the plurality of fan blade mounting members, wherein the gap remains defined between the outer edge of the first end of the fan blade and the outer surface of the hub during the act of securing each fan blade relative to the corresponding fan blade mounting member, wherein the sleeve of each interface component continues to substantially close the gap during the act of securing each fan blade relative to the corresponding fan blade mounting member.

* * * * *